US009435151B2

(12) United States Patent
Tanabe

(10) Patent No.: US 9,435,151 B2
(45) Date of Patent: Sep. 6, 2016

(54) COVER ASSEMBLY FOR ATTACHING TO A HINGE ARM

(71) Applicant: Toyota Motor Engineering & Manufacturing North America, Inc., Erlanger, KY (US)

(72) Inventor: Junji Tanabe, Commerce, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 0 days.

(21) Appl. No.: 14/167,386

(22) Filed: Jan. 29, 2014

(65) Prior Publication Data

US 2015/0211274 A1 Jul. 30, 2015

(51) Int. Cl.
*E05D 11/00* (2006.01)
*E05D 5/06* (2006.01)

(52) U.S. Cl.
CPC ..... *E05D 11/0054* (2013.01); *E05D 5/062* (2013.01); *E05D 2005/067* (2013.01); *Y10T 16/533* (2015.01)

(58) Field of Classification Search
CPC . Y10T 16/533; Y10T 16/5335; E05D 3/127; E05D 5/062; E05D 11/0054; E05D 2005/067; E05Y 2900/548; B62D 25/12
USPC ..... 16/250, 251; 49/398; 296/76, 193.08, 296/56, 146.11
See application file for complete search history.

(56) References Cited

U.S. PATENT DOCUMENTS

| | | | | |
|---|---|---|---|---|
| 2,460,171 | A | 1/1949 | Gessler | |
| 2,688,764 | A | 9/1954 | Squire | |
| 4,982,993 | A | 1/1991 | Okazaki et al. | |
| 5,224,240 | A * | 7/1993 | Smith et al. | 16/251 |
| 6,317,925 | B1 * | 11/2001 | Pietryga et al. | 16/250 |
| 7,618,084 | B2 | 11/2009 | Kimura | |
| 7,651,148 | B2 | 1/2010 | Hustyi et al. | |
| 7,673,928 | B2 | 3/2010 | Walker et al. | |
| D627,690 | S | 11/2010 | Madden | |
| 7,987,554 | B2 * | 8/2011 | Hakamata et al. | 16/250 |
| 2013/0076073 | A1 | 3/2013 | Tanaka et al. | |

FOREIGN PATENT DOCUMENTS

| | | | |
|---|---|---|---|
| JP | 56025063 | A * | 3/1981 |
| JP | H11136830 | A | 5/1999 |
| JP | 2005-232956 | A | 9/2005 |

* cited by examiner

*Primary Examiner* — William Miller
(74) *Attorney, Agent, or Firm* — Dinsmore & Shohl LLP

(57) ABSTRACT

A cover assembly for attaching to a vehicle hinge arm including an elongate body and including one or more clips supported upon an inner facing surface which are adapted to engage the hinge arm. A two piece structure formed upon the inner surface of the body includes a first component integrally formed with or otherwise secured upon the body and a second component affixed upon the first component and configured to receive a mounting location of the clip.

17 Claims, 7 Drawing Sheets

COVER ASSEMBLY FOR ATTACHING TO A HINGE ARM

FIELD OF THE INVENTION

The present invention discloses a cover assembly incorporating a clip for attaching the assembly to a hinge arm such as incorporated into a vehicle trunk.

BACKGROUND OF THE INVENTION

The prior art generally teaches the concept of covering a vehicle hinge. Examples of hinge coverings include the tailgate hinge cover of Kimura, U.S. Pat. No. 7,618,084 and the motorcycle trunk hinge cover of Madden U.S. D627,690.

SUMMARY OF THE INVENTION

The present invention discloses a cover assembly for attaching to a vehicle hinge arm. A curved elongate body corresponds to the profile of the hinge arm and includes one or more clips supported upon an inner facing surface thereof which are adapted to engage the hinge arm.

A two piece structure is provided upon the inner surface of the body and includes a first component integrally formed with or otherwise secured upon the body. A second component is affixed upon the first component and can exhibit a shelf configured to receive an inserting base of a separately attachable clip.

Non-limiting variations of the assembly can include the first component provided as a thin walled structure molded with the body. The first component can also provide for correct location of the shelf component during installation and by exhibiting one or more posts with seat through apertures in the shelf during assembly, and which can be melted to heat stake the components together.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
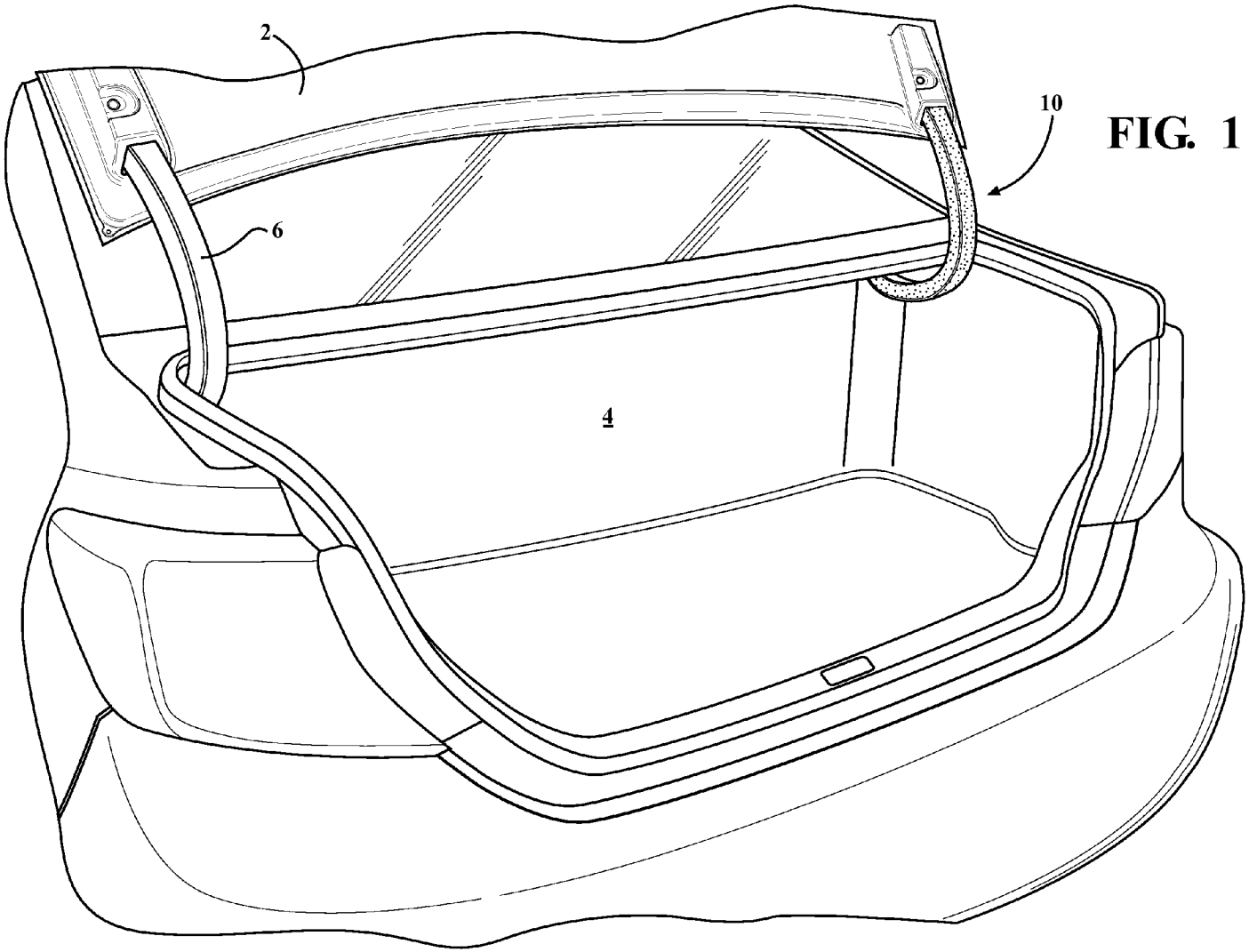
FIG. 1 is an environmental illustration of a deck lid and supporting hinge arms in an open trunk position and illustrating a covering assembly according to one non-limiting configuration secured to a selected hinge arm.
Figure 3:
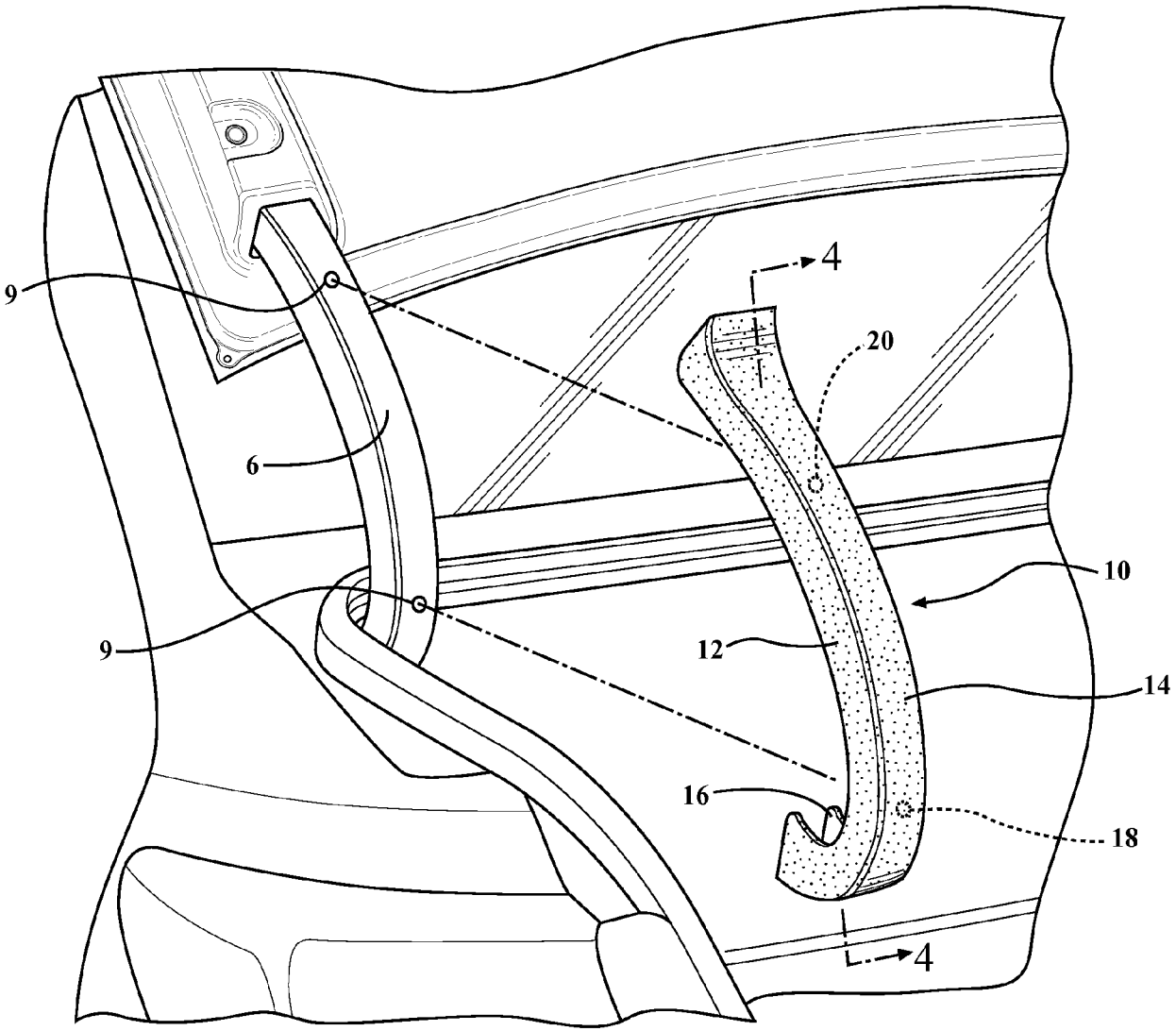
FIG. 3 is a further environmental perspective of the arrangement in FIG. 1 with the cover assembly depicted in exploded fashion with the hinge arm, and further illustrating the inner surface clip supporting structure in phantom aligning with receiving apertures formed in the hinge arm.
Figure 4:
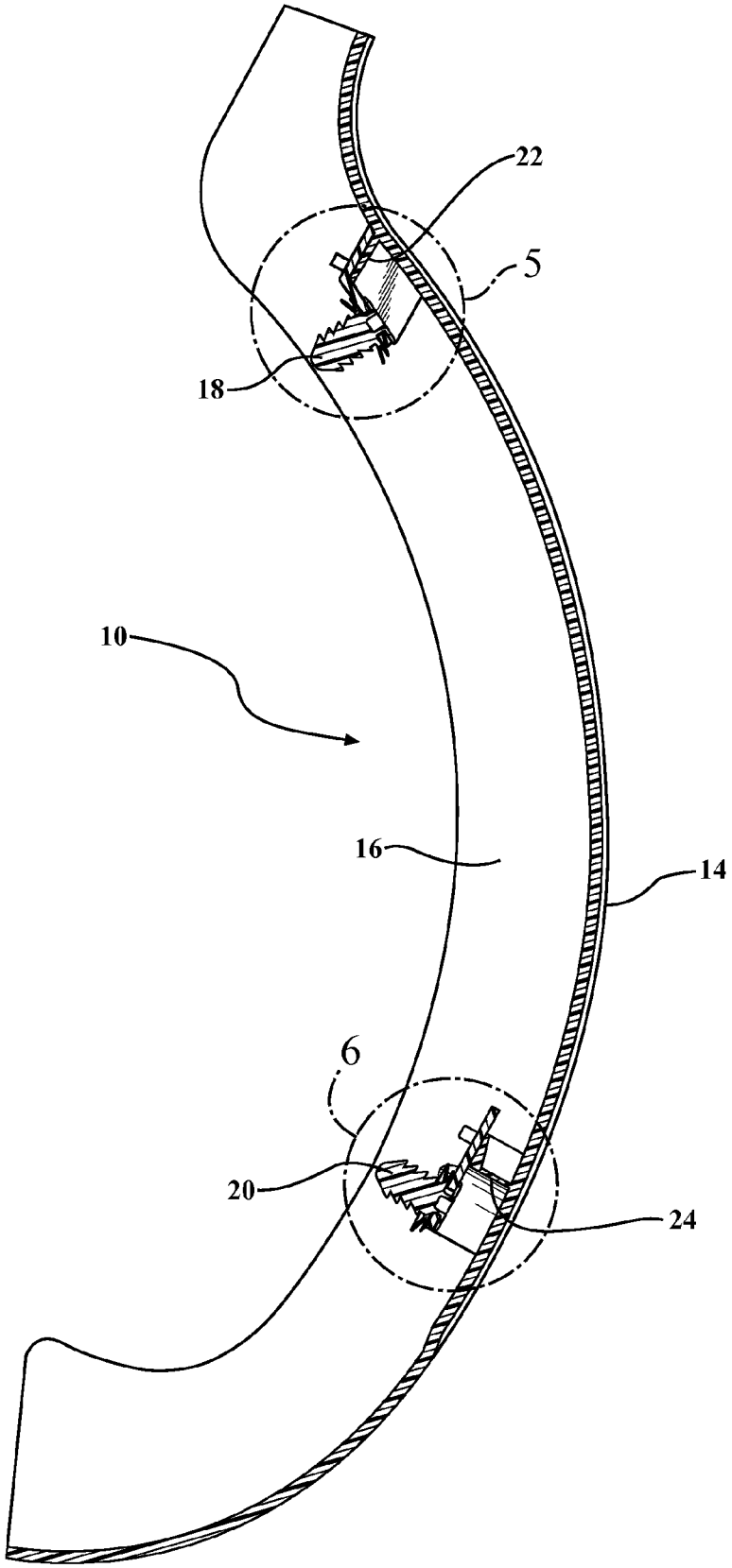
FIG. 4 is a lengthwise cutaway of the cover assembly illustrating first and second variations of a two piece structure for supporting each of a pair of clips.

A cover assembly, shown generally at 10 in each of FIGS. 3-4, is provided according to a non-limiting depiction of the present inventions for attaching to a hinge arm of a vehicle, such as in one non-limiting application being incorporated into a trunk deck lid assembly. FIG. 1 depicts an environmental illustration of a deck lid 2 which is pivotally supported over a trunk interior 4 by a pair of hinge arms, one of which is illustrated uncovered at 6 and the other hidden underneath the covering assembly 10.

Figure 2:
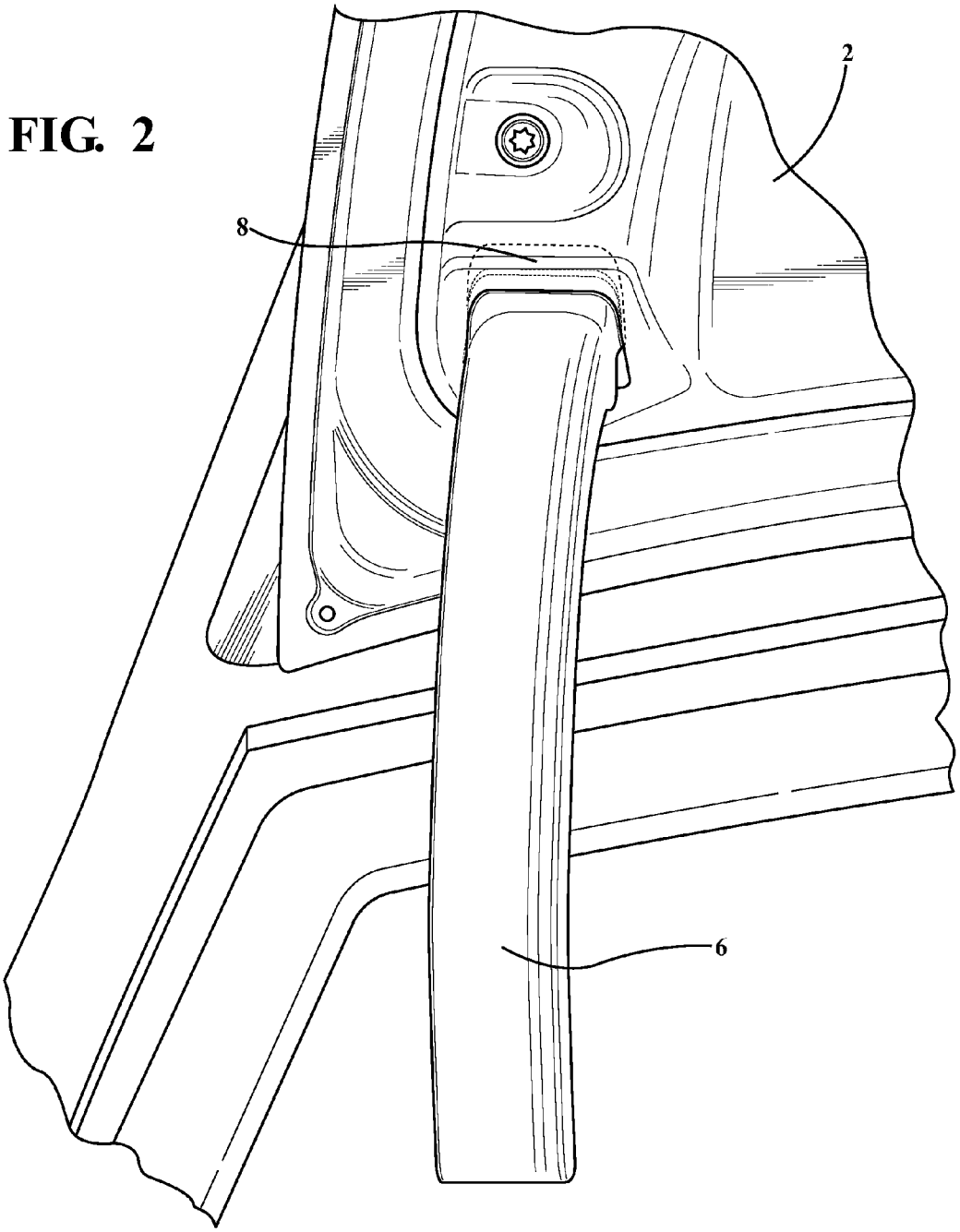
FIG. 2 is an enlarged and rotated view of a hinge arm and trunk deck lid shown in FIG. 1.

FIG. 2 is an enlarged and rotated view of selected (left side) hinge arm 6 and trunk deck lid 2 shown in FIG. 1. Further illustrated in phantom are mounting locations 8 for securing the hinge arms 6 to the spaced apart underside locations of the deck lid 2 depicted in FIG. 1. Not clearly referenced, however evident from FIG. 1, are underside interior locations to which the inner curved ends of the hinge arms 6 are secured to provide structural support to the deck lid 2.

Referring to FIGS. 3-4, each of further environmental perspective and lengthwise cutaway views are shown of the cover assembly 10, and which can be produced as a plastic in one non-limiting application from a suitable injection molding or other forming operation which provides the further benefit of creating any desired surface texture and/or coloring in order to match the vehicle interior and décor. It is also understood that the covering assembly 10 can be constructed from a metal, such as during a stamping operation, or can be produced according to any other process.

The covering assembly 10 depicted in FIG. 3 is shown with a generally elongate, curved and three sided body, this including in cross section a pair of spaced apart sides 12 and 16 which are interconnected by a central interconnecting side 14 exhibiting a desired bend or curvature and which is designed to match the extending profile the hinge arm 6. The arm 6 can also exhibit any tubular or other cross sectional profile, such as by example a modified four sided cross sectional profile with one or more rounded edges, and to which a covering body having one or more sides can be secured in a desired fashion. The above said, the hinge arm 6 in FIG. 3 is depicted as having a tubular and three sided shape, such that a variant of the inventions contemplates a three sided body mounting over the hinge arm for obscuring all but a hidden reverse facing side (not shown) associated with the hinge arm 6.

One or more clips, shown in phantom at 18 and 20 in FIG. 3 and in cutaway in FIG. 4, are provided at spaced or elevated locations relative to an inner engaging surface of the elongate body and are designed to engage within apertures 9 (FIG. 3) configured within the hinge arm 6 in order to secure the covering assembly 10 in the manner also depicted in FIG. 1. It is also understood that the covering assembly of the present invention is not limited to the use of a clip such as shown at 18 and 20, and that other fastening structures can likewise be incorporated into or upon the covering body to facilitate engagement to the hinge arm, such as which can be modified so as not to require mounting apertures to be pre-formed into the hinge arm.

Referencing again the lengthwise cutaway of the cover assembly depicted in FIG. 4, first and second variations are depicted of a two piece structure for supporting each of the pair of clips 18 and 20 in the manner shown. While the present invention in its broadest application contemplate mounting the clip or other engagement structure directly to or upon the inner surface of the covering body (such contemplating being either in a non-elevated or elevated/spaced relationship relative to that inner surface), one non-limiting application as illustrated provides for the creation of an inner support or superstructure for supporting and arraying the clips 18 and 20 at desired locations along the inside of the covering body and to facilitate mounting to the hinge arm.

Without limitation, the clip supporting structure incorporated into the covering assembly 10 can include any number of different designs, including one or more inter-assembly portions, and which can be produced in part or in whole with the covering body during its initial formation, as well as post applied or secured in any manner desirable. In one variant, as will be described in further detail, a two piece construction is provided for supporting each of the clips 18 and 20, and which is referenced in the relevant technical art as a "doghouse," which enables the clip to be supported in a desired elevated and angled or arrayed fashion relative to the inside surface of the body.

Figure 5:
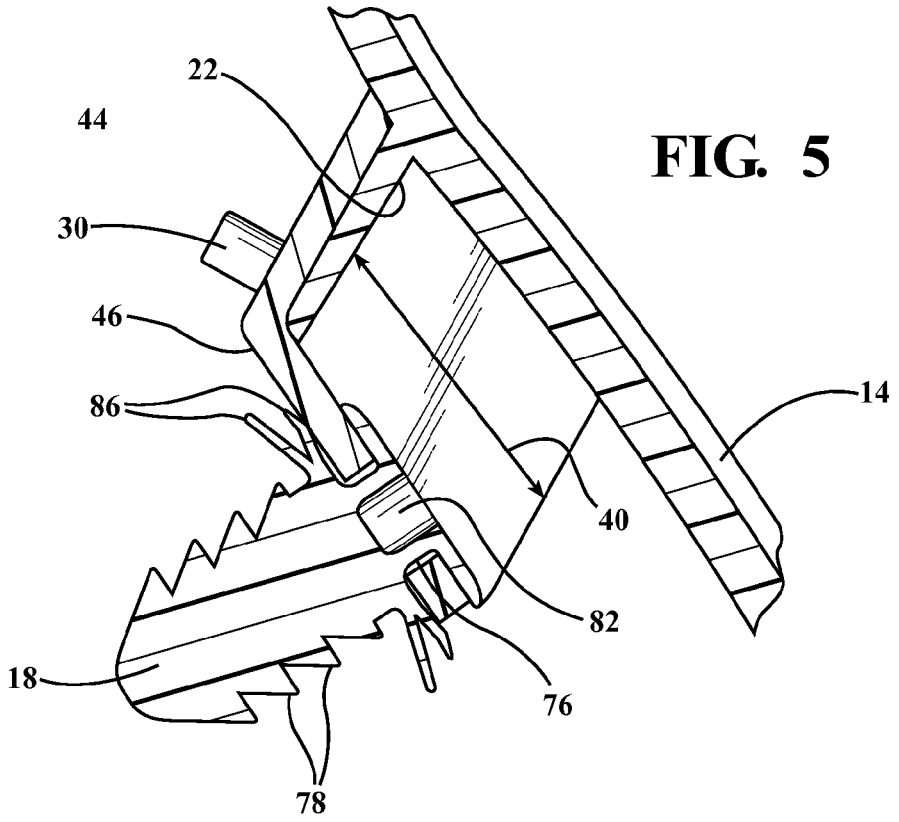
FIG. 5 is an enlarged view of the clip and two piece supporting structure referenced at section 5 in FIG. 4 and which depicts a first configuration of a molded base and clip supporting shelf.
Figure 6:
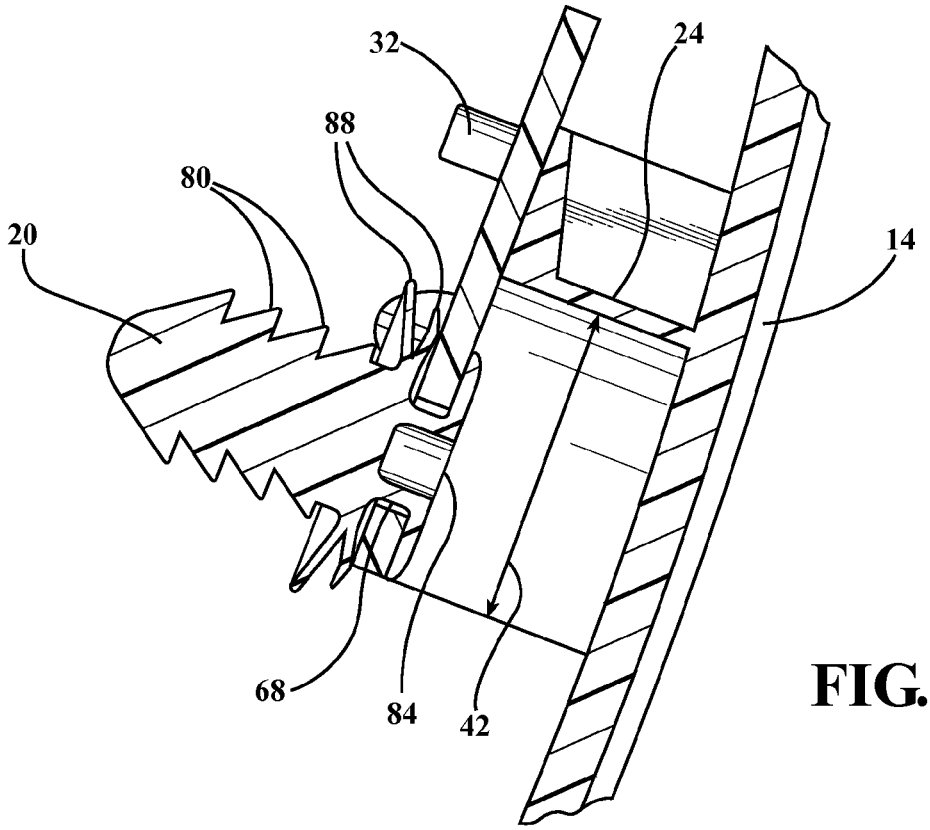
FIG. 6 is an enlarged view of the clip and two piece supporting structure referenced at section 6 in FIG. 4 and which depicts a second configuration of a molded base and clip supporting shelf.

With further reference to the enlarged sections of various "doghouse" structures of FIGS. 5 and 6, a first component includes a thin walled substrate or like supporting structure molded or otherwise integrally formed with the plastic body. Reference in particular is made to the inside surface of central or interconnecting side 14 of the elongate body as best shown in the FIG. 4 cutaway, with further reference to each of a molded wall 22 corresponding to clip 18 (in cutaway in FIG. 5 and in solid three dimension in FIG. 9) and a similar molded wall 24 corresponding to clip 20 (in cutaway in FIG. 6 and in solid three dimension in FIG. 7).

Figure 7:
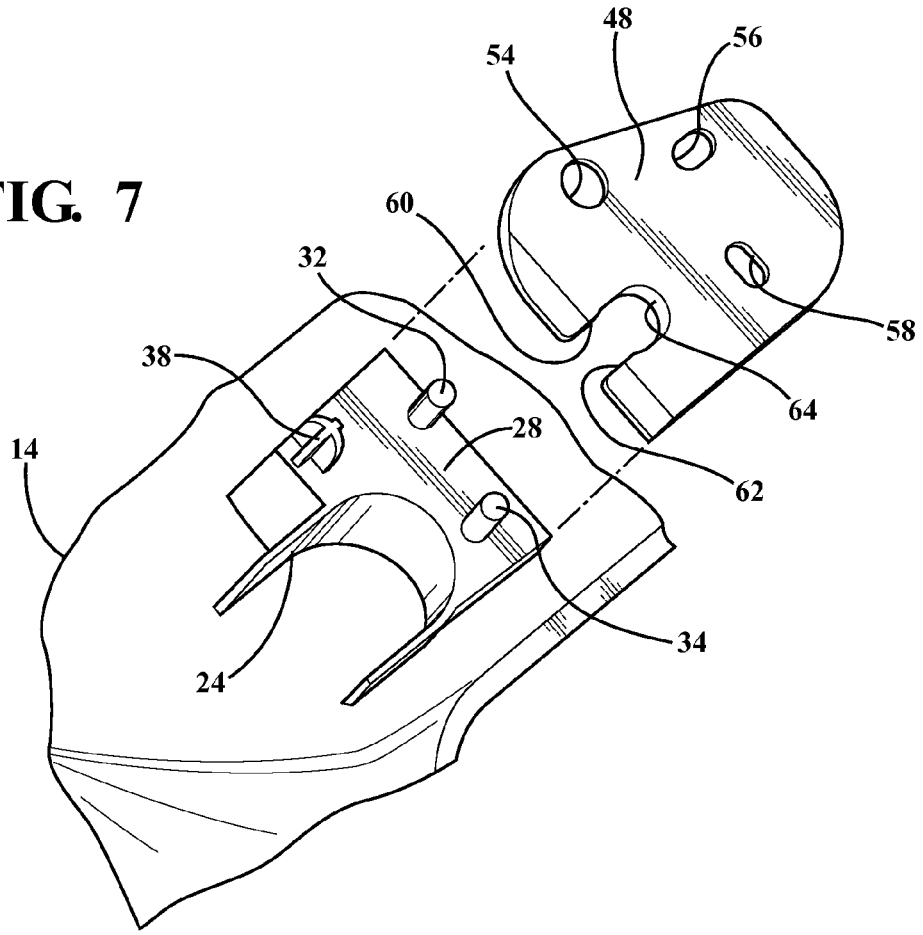
FIG. 7 is a partial exploded view of the two piece supporting structure of FIG. 6 and adjoining portion of the cover.
Figure 9:
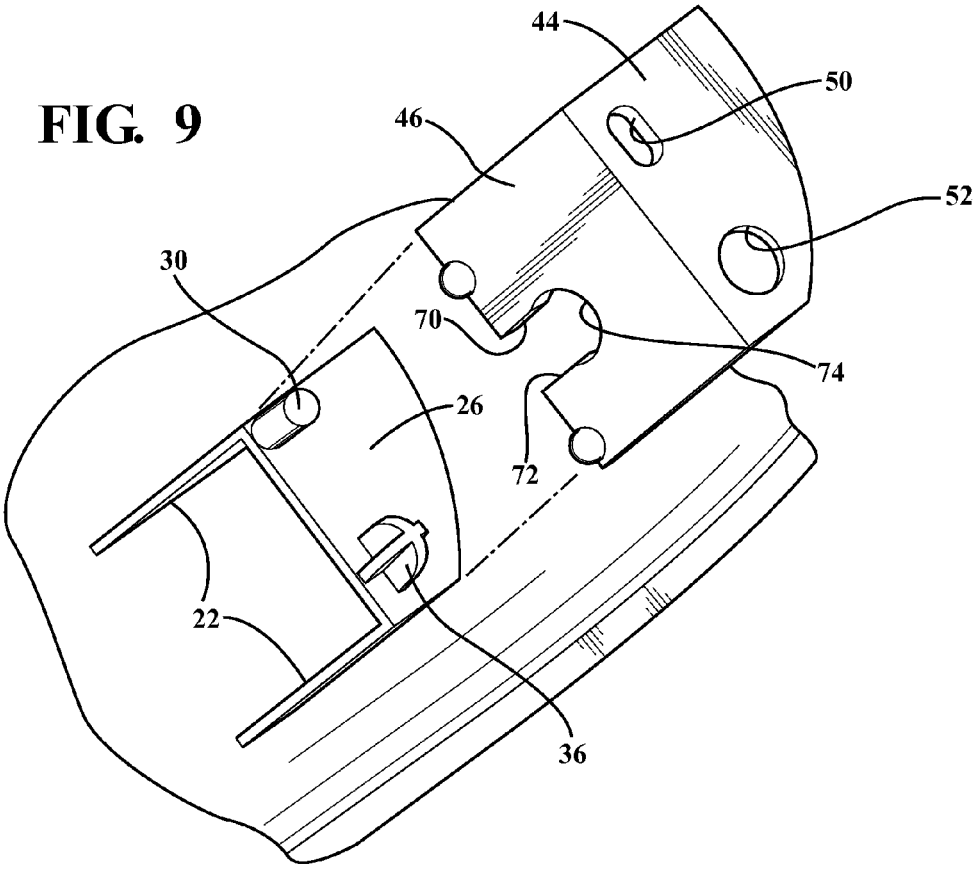
FIG. 9 is a partial exploded view of the two piece supporting structure of FIG. 5 and adjoining portion of the cover.

As shown in FIGS. 7 and 9, the molded wall structures 22 and 24 integrated into the covering body inner surface can have any desired shape, size or associated wall thickness (including varying thickness locations) and which facilitates supporting the clips 18 and 20 in the desired fashion for engaging the hinge arm 6. The supporting sectional perspectives of FIGS. 7 and 9 provide additional clarification of the structure of the molded base component associated with each of the clip supporting structures. This includes the molded base of FIGS. 5 and 9 exhibiting a top surface 26, with the molded base of FIGS. 6 and 7 exhibiting a top surface 28.

Heat staking (meltable) posts are illustrated at 30 in FIGS. 9, 22, and 32 and 34 in FIG. 7. In molded base 24, the posts project upwardly from the corresponding top surfaces 26 and 28 of the molded base components 22 and 24. A datum locator is also provided in upwardly projecting fashion from each top surface 26 and 28 and is further illustrated at 36 in FIG. 9 and at 38 in FIG. 7.

While not intended to limit the scope of the invention, additional design considerations may be used in the dimensioning of the molded base components for supporting clips 18 and 20 by providing walls 22 and 24 with minimal thickness to limit the occurrence of a vacuum draw of adjoining surface locations of the cover body during forming and solidifying, the effect of which is magnified in the instance of the molded base incorporating thicker walls. Other associated techniques employed during the formation of the molded base component of the doghouse structure are intended to provide a correct ratio of stroke length relative to undercut area (see as further referenced by arrow 40 in FIG. 5 and arrow 42 in FIG. 6) to prevent collapse or other comprise to the durability and effectiveness of the molded supported structure.

A second component is also provided for mounting atop each of the first base components 22 and 24, which is generally identified as a shelf (further defined as any plate shaped or other desired structure to which a base supporting location of the clip 18 and 20 can be anchored or otherwise secured). The shelf can be depicted in varying configurations, among which are included the two-sided ledge of FIG. 9 (see interconnected sides 44 and 46) and the single sided, planar shaped shelf of FIG. 7 (see 48). While not limited to any material construction, it is envisioned in one non-limiting application that the shelf can be constructed of a durable plastic or other suitable material similar as that employed with the in-molded base component upon which it is engaged.

As best appreciated from reviewing the elongate cutaway of FIG. 4, the configuration of the shelf and molded base (again collectively defining the clip supporting or "doghouse" structure) is selected in part to compensate for the placement of the clip relative to the inner contoured surface of the covering body, and in further part to ensure proper arrangement of the supported clips 18 and 20 in a fashion to ensure correct alignment and engagement with the hinge arm 6 and its associated mounting apertures 9 (FIG. 3). In particular, the two piece doghouse supporting structure associated with clip 18 is located at an area which must accommodate a higher bend or curvature location of the elongate body, while the corresponding doghouse structure associated with clip 20 a significantly lesser area of curvature.

Each shelf, as constructed, includes apertures for receiving in seating fashion both the heat stake posts and datum locator associated with the top surface of the base component. Reference in particular is made to apertures 50 and 52 configured in first angled side 44 of the ledge in FIG. 9, as well as further apertures 54, 56 and 58 in ledge 48 of FIG. 7.

Figure 8:
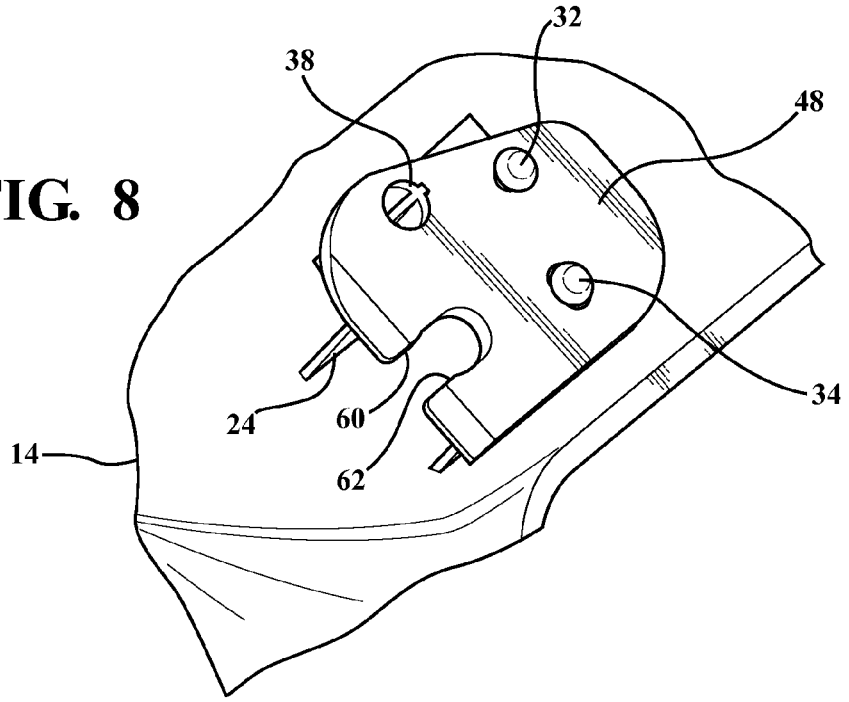
FIG. 8 is an assembled view of the supporting structure of FIG. 7 illustrating each of the datum locator, heat stake portions for securing the shelf to the molded base and clip receiving location defined in an edge of the shelf.
Figure 10:
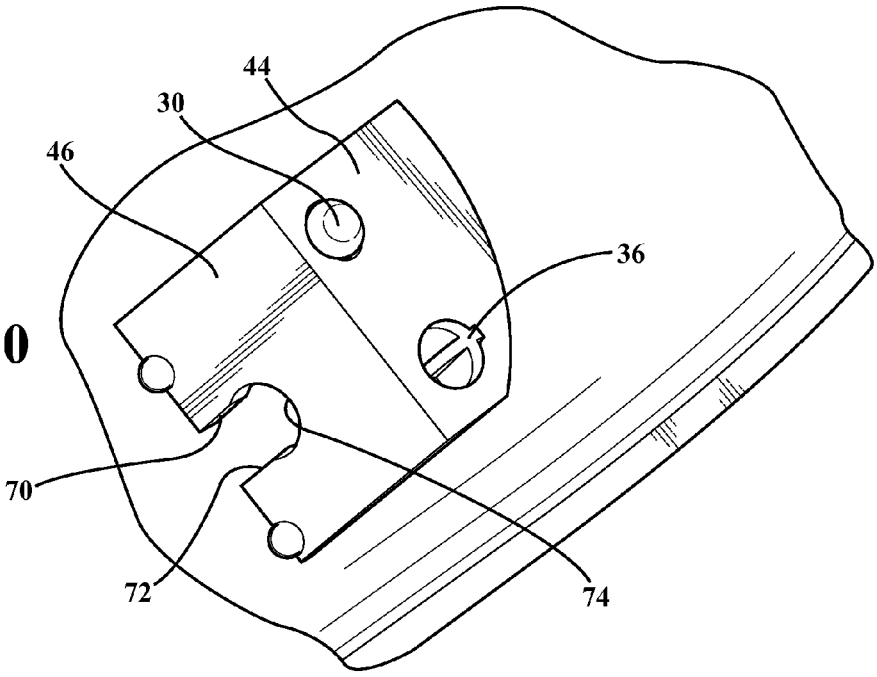
FIG. 10 is an assembled view of the supporting structure of FIG. 9 illustrating each of the datum locator, heat stake portions for securing the shelf to the molded base and clip receiving locations defined in an edge of the shelf.

FIG. 10 illustrates the two sided shelf 44/46 anchored to the molded base 22, the protocol for which includes first inserting the post 30 and datum locator 36 through the indicated apertures 50 and 52, following which the post is heat staked (melted) to affix the shelf in an elevated and interior volume defining relationship with the base 22. Similarly the single sided (or plate shape) shelf 48 in FIG. 8 is mounted to the base 24 by seating the posts 32, 34 and datum locator 38 through the opening 56, 58 and 54 following which the posts are melted over adjoining plate construction of the shelf 48 which surround the apertures.

The datum locator (shown at 36 and 38 for the reconfigured in molded base 22 and 24) is designed into the top surface of the in molded base to prevent shifting of the shelf during the heat staking (melting) operation applied to the projecting posts. It is understood that reforming of posts 30 and 32/34 can be accomplished by other than heat staking or melting. Such alternate forming processes can include mechanical deforming of the posts, with the further understanding that other structures can be employed to assist in preventing misalignment of the shelf and associated clip during installation atop the base component of the two piece doghouse structure. It is further envisioned that datum locators 36 and 38 can also be reconfigured in any manner desired in order to provide proper alignment of the associated shelf component during anchoring to the structure, or can be removed in favor of another structure.

Typically, prior to affixing the shelf to the molded base, clips 18 and 20 are first anchored to the shelf. As best shown in FIG. 7, a pair of spaced apart surfaces 60 and 62 defines a narrow passageway extending from a perimeter edge of the single sided shelf 48, surfaces 60 and 62 communicating with an interior rim surface 64 exhibiting a modestly enlarged diameter. Clip 20 (see FIG. 6) includes a narrowed and rim defining base location 68 which can be friction fit into the passageway defining surfaces 60, 62 and 64 in order to affix the clip in a sideways installed fashion to the shelf 48. Similarly, the two sided shelf of FIG. 9 includes a similar arrangement of passageway defining surfaces 70, 72 and 74 for receiving a base location 76 of clip 18 in order to similarly mount the clip to the shelf 44/46.

Clips 18 and 20 can be constructed of any resilient material, which can be secured in a number of different fashions to the associated shelf components of the doghouse structure so that the upper extending bodies of the clips with their seating/retaining ribs (see annular profile 78 for clip 18 in FIG. 5 and similar profile 80 for clip 20 in FIG. 6) are adequately anchored and positioned relative to the elongate cover body for subsequent affixing to the hinge arm 6. In the illustrated variants of FIGS. 5-6, the base of clips 18 and 20 exhibit a hardened and embedded insert (shown at 82 in FIG. 5 for clip 18 and at 84 in FIG. 6 for clip 20), which biases against the reduced diameter rim (at 68 in FIG. 6 and further at 76 in FIG. 5) to compress and retain the narrowed base of the clip to the shelf.

Other non-illustrated variants can include, without limitation, redesigning the base portion of the clips from that shown in FIGS. 5-6 to integrate a push fit construction to anchor the clip through an aperture in the shelf and into a recessed underside interior formed with the in-molded base (22 or 24). It is further envisioned that any arrangement of laterally projecting wings (see as shown at 86 for clip 18 in FIG. 5 and further at 88 for clip 20 in FIG. 6 for assisting in providing laterally installed support to the shelf) can be redesigned or reconfigured to facilitate press-fit or other installation techniques.

Having described the invention, other and additional preferred embodiments will become apparent to those skilled in the art to which it pertains and without deviating from the scope of the appended claims. This can include, without limitation, redesigning both the number and arrangement of clips and associated support structures to fit different hinge arm shapes and sizes.

As also previously described, the shaping of the in-molded walls (again at 22 and 24) formed with the elongate covering body can also be redesigned to vary from that shown and to establish any thickness, configuration or other profile which facilitates the positioning of the clip for subsequent engagement to the hinge arm. Likewise, either variation of the shelf can be modified to exhibit any other shape which provides the necessary supporting characteristics for the associated clip. This can include forming the shelf and clip as a single piece and then attaching to the molded base (or alternately forming the entire structural assembly upon the covering member as a single piece).

The invention claimed is:

1. A cover assembly for attaching to a hinge arm, comprising:

an elongate body having an inner surface;

a structure having a base formed with said body and configured upon said inner surface;

a clip engaged to said structure and projecting from a location on said body, said clip adapted to engage the hinge arm in order to mount said body thereto; and said structure further including a shelf secured atop said base, said shelf including a location for receiving a mounting location of said clip.

2. The cover assembly of claim 1, said base having a top surface and further comprising at least one mounting post extending from said top surface, said shelf including at least one aperture for seating said mounting post.

3. The cover assembly of claim 2, said base further comprising a datum locator extending from a further location of said top surface, said shelf including at least one additional aperture for seating said datum locator and to prevent shifting of said shelf during reforming of said mounting posts over said shelf.

4. The cover assembly of claim 1, said shelf location comprising a passageway for receiving said clip in a laterally engaging direction.

5. The cover assembly of claim 4, further comprising said mounting location of each clip exhibiting a hardened and embedded insert biasing against a rim of said passageway to compress and retain said clip to said ledge.

6. The cover assembly of claim 1, said elongate body further comprising a pair of spaced apart sides which are interconnected by a central interconnecting side so that said body is adapted to overlay a matching cross sectional profile of the hinge arm.

7. The cover assembly of claim 6, at least said central interconnecting side further comprising a curvature adapted to match that of an exposed side of the hinge arm.

8. A cover assembly for attaching to a hinge arm associated with a vehicle trunk deck lid, said cover assembly comprising:

a plastic body exhibiting an elongate and curved shape and having a pair of spaced apart sides which are interconnected by a central interconnecting side so that said body is adapted to overlay a matching cross sectional profile of the hinge arm, said body having an inner surface, a structure formed with said body and configured upon said inner surface;

a shelf secured to said structure in order to mount said shelf in spaced fashion relative to said inner surface;

a clip engaged to said shelf; and said clip adapted to engage an aperture in the hinge arm in order to mount said body thereto.

9. The cover assembly of claim 8, said base having a top surface and further comprising at least one mounting post extending from said top surface, said shelf including at least one aperture for seating said mounting post.

10. The cover assembly of claim 9, further comprising a datum locator extending from a further location of said top surface to prevent shifting of said shelf during reforming of said mounting posts over said shelf.

11. The cover assembly of claim 8, said shelf further comprising a passageway configured into said shelf for receiving a mounting location of said clip in a laterally engaging direction.

12. The cover assembly of claim 11, said mounting location of said clip further comprising a hardened and embedded insert biasing against a rim of said passageway to compress and retain said clip to said shelf.

13. A cover assembly for attaching to a hinge arm associated with a vehicle trunk deck lid, said cover assembly comprising:

an injection molded body exhibiting an elongate and curved shape and having a pair of spaced apart sides which are interconnected by a central interconnecting side so that said body is adapted to overlay a matching cross sectional profile of the hinge arm, said body having a decorative exterior surface;

a pair of structures in-molded upon an inner surface of said body, each of said structures exhibiting a plurality of projections;

a pair of shelves, each exhibiting a plurality of receiving locations for seating said pluralities of projections in order to engage said shelves upon said in-molded structures;

a clip engaged to each of said shelves in spaced relationship relative to said inner surface of said body; and said clips adapted to engage apertures in the hinge arm in order to mount said body.

14. The cover assembly of claim 13, said base having a top surface, said projections associated with said in-molded structure further comprising at least one mounting post extending from said top surface.

15. The cover assembly of claim 14, said projections associated with said in-molded structure further comprising a datum locator extending from a further location of said top surface to prevent shifting of said shelf during reforming of said mounting posts over said ledge.

16. The cover assembly of claim 13, said ledge further comprising a passageway configured into said ledge for receiving a mounting location of said clip in a laterally engaging direction.

17. The cover assembly of claim 16, said mounting location of said clip further comprising a hardened and embedded insert biasing against a rim of said passageway to compress and retain said clip to said shelf.

* * * * *